United States Patent [19]

Steffen

[11] 3,991,913

[45] Nov. 16, 1976

[54] GRAIN BIN DOOR

[76] Inventor: Vincent B. Steffen, 321 E. Hamilton, New Hampton, Iowa 50659

[22] Filed: Mar. 13, 1975

[21] Appl. No.: 558,066

[52] U.S. Cl. ..... 222/156; 222/457; 222/545; 214/17 D; 52/196

[51] Int. Cl.[2] ..... B67D 5/38; B65G 65/40

[58] Field of Search. 222/156, 154, 457, 424.5–425, 222/526, 527, 158, 437, 450, 545, 476; 52/192, 196; 214/17 D

[56] References Cited

UNITED STATES PATENTS

| | | | |
|---|---|---|---|
| 235,082 | 12/1880 | Griffin | 222/457 X |
| 424,901 | 4/1890 | Raymond | 222/526 X |
| 1,138,753 | 5/1915 | Gussner et al. | 222/437 X |
| 1,208,075 | 12/1916 | Allsteadt | 52/196 X |
| 1,606,366 | 11/1926 | Hillman | 222/156 X |
| 1,640,583 | 8/1927 | Steinruck | 222/457 |
| 2,565,663 | 8/1951 | Osterbur et al. | 214/17 D X |
| 2,799,431 | 7/1957 | Bush et al. | 214/17 D X |
| 3,036,742 | 5/1962 | Wagoner et al. | 222/425 X |

FOREIGN PATENTS OR APPLICATIONS

| | | | |
|---|---|---|---|
| 519,878 | 12/1955 | Canada | 214/17 D |
| 521,886 | 2/1956 | Canada | 52/196 |
| 68,077 | 11/1913 | Switzerland | 52/192 |
| 1,723 | 1/1903 | United Kingdom | 52/192 |

*Primary Examiner*—Stanley H. Tollberg
*Assistant Examiner*—Charles A. Marmor
*Attorney, Agent, or Firm*—Henderson, Strom & Sturm

[57] ABSTRACT

A door for a grain bin having a container associated therewith which is adapted to be connected to a grain bin and extended into the grain storing portion of the grain bin. An opening is disposed in a lower portion of a rear wall of the container and a front wall of the container leading to the outside of the grain bin is removable and is optionally transparent. A grain port in the top rear wall of the container has a sliding gate associated therewith for opening or closing the grain port or metering grain through the grain port. An extension spout is formed on the front bottom of the container for selectively extending the bottom portion of the container, thereby facilitating a selectively controlled flow of grain out of the grain bin.

8 Claims, 4 Drawing Figures

GRAIN BIN DOOR

BACKGROUND OF THE INVENTION

The present invention relates generally to grain bins and more particularly to a grain viewing and sampling device for a grain bin.

One of the problems associated with the use of grain bins is the one of determining the condition of the grain within the grain bin. There are various ways of determining the condition of the grain within the grain bin, the most common of these methods including the step of taking samples of the grain from within the bin. These samples may be taken in various ways and have been taken through an opening in the top of the grain bin. In such a sampling situation, however, it is important to get more than just the surface grain in order to get a representative sample. Another way of attempting to get a grain sample is to merely open a side grain bin door and then attempt to take a sample therefrom. Once a grain bin door is open, however, the grain, of course, tends to flow out rapidly at an uncontrollable rate. This general problem was recognized long ago when it was desired to scoop shovels full of grain from a grain bin without having excess grain flow out of the grain bin during such a removal operation. U.S. Pat. Nos. 1,208,075, 1,217,424 and 1,417,316 are directed to solving this latter problem, for example.

In a modern day grain bin, however, large grain discharge doors are not needed, since augers are normally used to remove the grain from these bins. There is consequently no longer a real need for the rather complicated door devices of the art for discharging grain with a shovel. It is for this apparent reason that grain bin doors of the type disclosed in U.S. Pat. No. 3,184,805 have been developed.

There is, however, still a need to be able to view, examine, and test a representative sample of grain in a grain bin. Accordingly, some type of a simplified, yet versatile structure is desirable for this purpose. It is because of this above enunciated need that the present invention was developed.

SUMMARY OF THE INVENTION

A grain viewing and sampling device for a grain bin including a sampling container adapted to be placed into a grain bin and connected to a wall thereof. An opening in the rear wall of the container allows a sample of the grain to flow into the container. A front transparent wall allows viewing of the grain which flows into the container. The front wall of the device is also removable to allow a sampling of grain therefrom. A grain port in the top wall of the device has a flow control gate associated therewith for selectively allowing additional grain to flow into the device. A spout structure on the inner bottom of the device allows grain to flow out of the device and this spout structure directs such grain into a bucket or other detached container for removal of samples to be tested and examined at a point remote from the grain bin.

An object of the present invention is to provide a device for examining the grain in a grain bin.

Another object of the present invention is to provide a device for viewing a representative sample of grain in a grain bin.

A further object of the invention is to provide a grain sampling device in which the amount of flow of grain therefrom is readily controllable.

Still another object of the invention is to provide a grain spout control for a grain sampling device.

A still further object of the invention is to provide a grain viewing and sampling structure for a grain bin which is simple and economical to use, but which is nevertheless extremely dependable.

Other objects, advantages, and novel features of the present invention will become apparent from the following detailed description of the invention when considered in conjunction with the accompanying drawings.

DESCRIPTION OF THE PREFERRED EMBODIMENT

Figure 1:
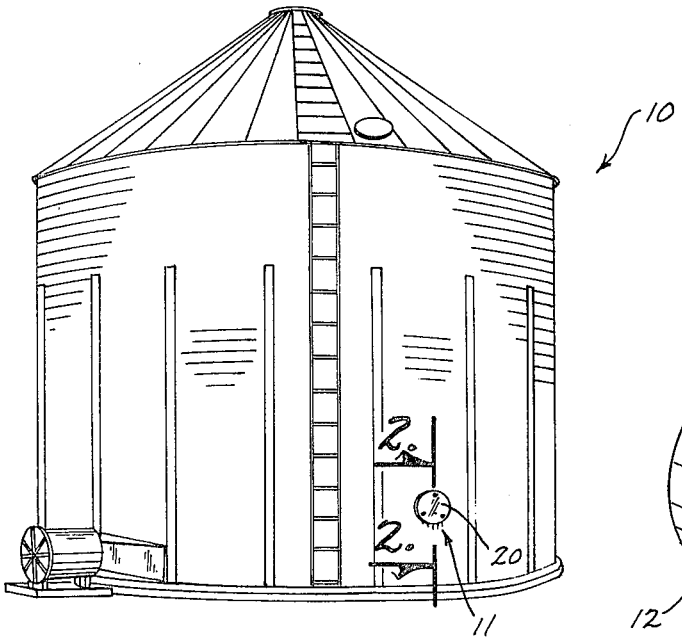
FIG. 1 is a perspective view of a grain bin employing the present invention.

Referring now to the drawings wherein like reference numerals designate identical or corresponding parts throughout the several views, FIG. 1 shows a grain bin 10 having a grain viewing and sampling device 11 attached thereof.

The grain viewing and sampling device 11 of the present invention is formed generally of a cylindrical tube 12 having a rear end wall 13 attached to one end thereof. An opening 14 is disposed at the lower end of the rear end wall 13 and is of a generally semi-circular shape, as is the upper rear end wall 13.

Figure 2:
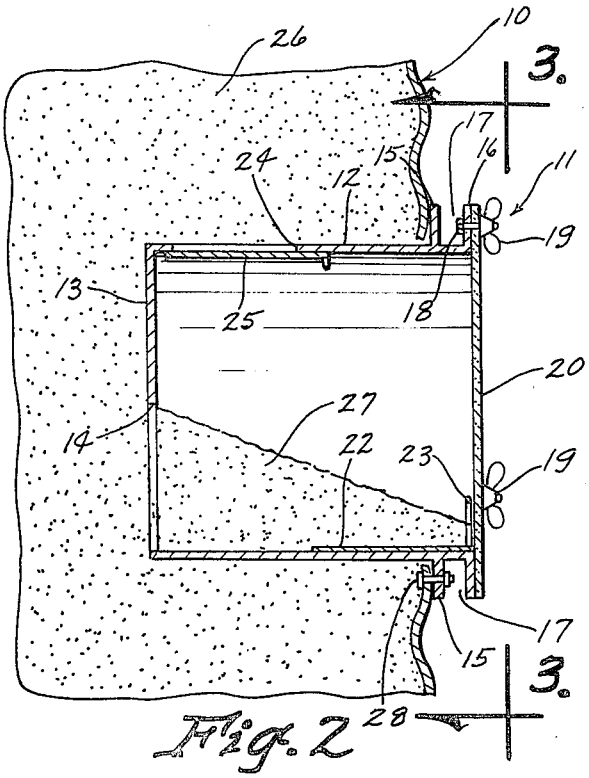
FIG. 2 is a partial cross-sectional view taken along line 2—2 of FIG. 1.
Figure 3:
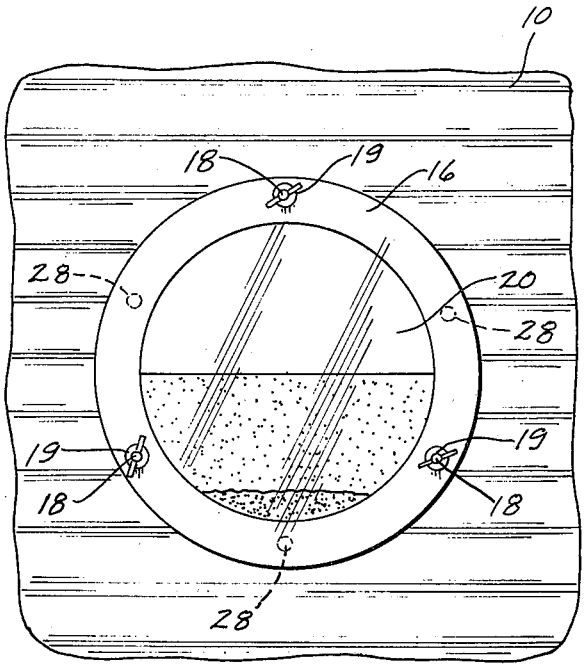
FIG. 3 is a front view taken along line 3—3 of FIG. 2 of the present invention installed on a grain bin.

At the other end of the cylindrical tube 12 are a pair of annular flanges 15 and 16 which form an annular groove 17. The groove 17 allows the device to be attached to the bin 10 by nut and bolt devices 28. The nut and bolt devices 28 tend to help hold the tube 12 properly positioned so that it is extending into a grain bin as shown in FIG. 2. The bolts 18 and wing nuts 19 serve to hold on the front cover 20. These bolts 18 are easily accessible even when the device 11 is on the bin because of the groove 17. The front cover 20 is preferably made of a transparent plastic type of material, but it is to be understood that this front cover 20 may also be made of opaque materials, such as sheet steel or other metal.

Figure 4:
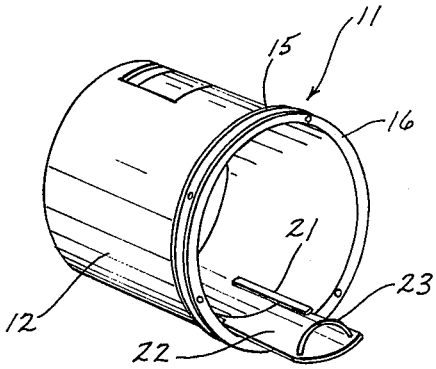
FIG. 4 is a perspective view of the present invention with the front panel removed and being detached from a grain bin.

Disposed along the bottom of the tube 12 are groove forming metal strips 21, which serve to slideably receive the spout plate 22, which is movable between the extreme positions shown in FIGS. 2 and 4. A wire-like looped rod 23 is secured, such as by welding, to the front of the plate 22 for facilitating the manual movement of the plate 22 between its extreme positions. It is noted that the shape of the spout plate 22 is generally of a shape complimentary to the tube 12 to thereby smoothly slide along the tube 12 without particles of grain being lodged between the tube 12 and the spout plate 22.

On the top portion of the sidewalls of the tube 12 is a square or rectangular grain port 24. A slide control plate 25 is disposed across the grain port 24 as shown in FIG. 2, but it is to be understood that this control plate 25 is movable from the position shown in FIG. 2 to any intermediate metering position and to a position wherein it completely opens the grain port opening 24. This control plate 25 is, like the spout plate 22, of a shape generally complimentary to the shape of the tube 12. It is to be further understood that the control plate 25 is mounted to the top of the tube 12 in a fashion similar to the groove forming metal strips 21 used to slideably receive the spout plate 22 on the lower part of the tube 12. It is to be understood, however, that the manner of affixing these slide control plates 25 and 22 to the tube 12 are not critical, and other means of mounting these plates 22 and 25 will occur to those skilled in the art.

In operation, the present invention 11 is placed within a circular hole in a grain bin 10 as shown finally in FIG. 2. When the grain 26 is placed into the grain bin 10, the grain will naturally flow through the opening 14 and into the interior of the tube 12 at approximately the level shown in FIG. 2. If the front cover 20 is then of a transparent material, one can readily view the grain 27 which is inside of the tube 12. If the front cover 20 is made of an opaque material, removal thereof will allow such viewing. This viewing can be quite valuable, since many grain characteristics can be observed merely from grain appearance. For example, moldy or crusty grain would indicate to an observer that the grain is, or has been, too wet, without the actual need to physically extract the grain 27 to discover this characteristic.

Sometimes, however, it is necessary to actually remove some of the grain 27 and to examine and test it. This can be done by merely removing the wing nuts 19 and then the front cover 20. It will be noted also that, becuase of the design of the present invention, the grain may obviously be observed as well as sampled when the cover 20 is removed, without a fear of having the entire grain bin empty on top of the observer. When a larger sample of grain is desired, or when a small amount of grain is desired to be emptied from the bin, the control plate 25 can be slideably moved to open all or part of the top grain port 24. When this is done, the grain 26 which is physically located directly above the grain port 24 will empty into the tube 12 and this grain flow will generally continue until the control gate 25 is closed or some other clogging of the grain flow occurs. When the control plate 25 is open, the front cover 20 removed and the spout plate 22 pulled out in the position shown in FIG. 4, grain will flow directly through the grain port 24 and out through and under the handle 23 on the spout plate 22. Consequently, if a bucket or other sampling device is placed below the spout plate 22, as shown in FIG. 4, and then the grain port 24 is opened by moving the control plate 25, the grain 26 will flow directly into the bucket until the control plate 25 is closed or nearly closed.

Accordingly, it can be seen from the above that a very effective grain viewing and sampling device has been disclosed which accomplishes all of the aforesaid objects. Obviously many modifications and variations of the present invention are possible in light of the above teachings. It is therefore to be understood that, within the scope of the appended claims, the invention may be practiced otherwise than as specifically described.

I claim:

1. A grain viewing and sampling device in combination with a grain bin having sidewalls, comprising:
   - a container having a rear wall and a front wall, and laterally extending walls, extending from the rear wall to the front wall, said rear wall having an opening in a lower portion thereof;
   - means for connecting a front portion of said container to a grain bin sidewall whereby said container extends into said grain bin;
   - means connected to said container for selectively removing said front wall;
   - extension means connected to a front-bottom portion of said container, for extending forwardly the effective bottom of said container whereby said extension means serves as a spout for allowing grain to pour into a grain sampling device;
   - and wherein a grain port is disposed in a top portion of said laterally extending walls of the container and said device includes means for opening and closing said grain port.

2. A grain viewing and sampling device as claimed in claim 1 wherein said means for opening and closing said grain port includes means for controlling the flow of grain through said grain port.

3. A grain viewing and sampling device as claimed in claim 1 wherein said means for opening and closing said grain port comprises a gate valve disposed over said grain port.

4. A grain viewing and sampling device as claimed in claim 1 wherein said extension means comprises a plate having upper side edges and a shape complimentary to the bottom of said container;
   - two grooves formed on the bottom of said container; and
   - the sides of said plate being slideably received in said grooves.

5. A grain viewing and sampling device as claimed in claim 4 wherein a front portion of said plate has a handle attached thereto.

6. A grain viewing and sampling device as claimed in claim 5 wherein said handle is a curved rod, the ends of which are secured to the front upper side edges of said plate.

7. A grain viewing and sampling device as claimed in claim 1 wherein said front wall is formed of a transparent material.

8. A grain viewing and sampling device as claimed in claim 1 wherein said container is of a generally cylindrical configuration.

* * * * *